US005468672A

United States Patent [19]

Rosvold

[11] Patent Number: 5,468,672

[45] Date of Patent: Nov. 21, 1995

[54] THIN FILM RESISTOR AND METHOD OF FABRICATION

[75] Inventor: Warren C. Rosvold, Sunnyvale, Calif.

[73] Assignee: Raytheon Company, Lexington, Mass.

[21] Appl. No.: 84,883

[22] Filed: Jun. 29, 1993

[51] Int. Cl.[6] ..... H01C 1/012

[52] U.S. Cl. ..... 437/60; 437/918; 437/142; 338/308; 204/192.21

[58] Field of Search ..... 437/918, 60, 142, 437/161, 164; 148/DIG. 136; 338/308, 314; 427/101; 204/192.21, 192.15

[56] References Cited

U.S. PATENT DOCUMENTS 4,510,178 4/1985 Paulsan et al. ..... 437/918
4,759,836 7/1988 Hill et al. ..... 204/192.21
4,952,904 8/1990 Johnson et al. ..... 338/314
5,023,589 6/1991 Hall ..... 204/192.21
5,173,440 12/1992 Tsunashima et al. ..... 437/164

*Primary Examiner*—Olik Chaudhuri
*Assistant Examiner*—S. Mulpuri
*Attorney, Agent, or Firm*—William R. Clark

[57] ABSTRACT

A method of fabricating a thin film resistor includes a step of sputter depositing a thin film of resistive material such as a chromium diboride compound on an insulative substrate using an argon sputter gas having a percentage of dopant such as nitrogen selected to optimize a trade off between desirably increasing the thickness of the film and undesirably increasing the temperature coefficient of resistance. A cap layer having a solid diffusant such as free chromium is deposited over the thin film of resistive material. The cap layer serves to protect the thin film of resistive material during subsequent patterning of conductors using wet etching, and also the solid diffusant diffuses into the resistive material during subsequent thermal treatment to drive the temperature coefficient of resistance back down.

6 Claims, 5 Drawing Sheets

THIN FILM RESISTOR AND METHOD OF FABRICATION

BACKGROUND OF THE INVENTION

The field of the invention generally relates to semiconductor devices, and more particularly relates to thin film resistors and a method of fabricating such resistors.

As is well known, integrated circuits and thin film devices frequently require resistors as part of the circuitry, and thin film resistors are commonly used. Thin film resistors generally consist of a thin film of resistive material deposited such as by sputter deposition on a layer or substrate of insulative material with end contacts on the resistive material. The end contacts or interconnections are then connected to circuit components in a conventional manner.

There are a number of criteria by which the quality of thin film resistors are evaluated. For example, it is generally desirable that a thin film resistor have a minimum thickness such as 30 angstroms. When a thin film resistor is too thin, it may be unable to handle relatively large current densities during operation. It is further desirable that a thin film resistor have uniform thickness and properties to insure consistency and stability. Also, it is generally desirable that thin film resistors have a target or intended sheet resistance which is expressed in ohms per square. Further, it is normally desirable that thin film resistors have a very low temperature coefficient of resistance, or at least a temperature coefficient of resistance that is suitably matched to a particular application. For example, it may be desirable to have a temperature coefficient of resistance that is either positive or negative. The temperature coefficient of resistance defines how the sheet resistance varies with temperature. Therefore, a thin film resistor with a zero coefficient of resistance does not vary in resistance as the temperature changes.

It may be desirable to use certain resistive materials such as, for example, 85% chromium diboride with 15% silicon chromide by atomic weight. This particular resistive material and others can readily be used to fabricate thin film resistors having relatively low sheet resistances such as 1000 ohms per square and less. However, this material and others are not generally suitable if it is intended that the sheet resistance be relatively high such as, for example, 1500 ohms per square or higher. In particular, due to the inherent properties of this particular material and others, the thickness of a thin film resistor must be undesirably thin in order to attain relatively high sheet resistances. Not only are such film resistors unable to handle relatively high current densities during operation, but it is difficult to attain thickness uniformity with extremely thin films of material. A dopant could be used to increase the sheet resistance of such a material, but such action would also generally raise the temperature coefficient of resistance, and that would be undesirable as discussed above.

SUMMARY OF THE INVENTION

In accordance with the invention, a method of fabricating a thin film resistor first comprises the step of sputter depositing a thin film of a resistive material on an insulative substrate in a reactive medium to increase, for a predetermined sheet resistance, the thickness of the thin film while also increasing the temperature coefficient of resistance of the resistive material. The temperature coefficient of resistance may initially be negative, in which case increasing the coefficient means making it more negative. The next step is depositing over the thin film a cap layer comprising a solid diffusant wherein, during thermal treatment, the solid diffusant diffuses into the resistive material of thin film to reduce the temperature coefficient of resistance of the resistive material from the increased level resulting from the sputter depositing in the reactive medium. In one example, the reactive medium may be a predetermined nitrogen concentration in an argon sputter gas. In fact, the nitrogen percentage may be selected to optimize a trade off between desirably increasing the thickness of the thin film and undesirably increasing the temperature coefficient of the resistive material. Herein, temperature coefficient refers to the change in resistance or sheet resistance as a result of temperature change. The resistive material may comprise chromium diboride, and more particularly comprise 85% chromium diboride with 15% silicon chromide by atomic weight. The solid diffusant of the cap layer may comprise free chromium such as in chromium silicon monoxide. The method may preferably comprise a further step of selecting a thickness ratio between the thin film and the cap layer to determine or fix the temperature coefficient of resistance of the resistive material.

The invention may also be practiced by a semiconductor device comprising an insulative substrate, a thin film of resistive material disposed on the insulative substrate wherein the resistive material includes a sputter deposited dopant to increase, for a predetermined sheet resistance, the thickness of the thin film. However, the dopant also increases the temperature coefficient of the resistive material. The device further includes a cap layer comprising a solid diffusant covering the thin film of resistive material. Also the resistive material further comprises solid diffusant diffused from the cap layer during a heat treatment wherein the solid diffusant serves to lower the temperature coefficient of the resistive material to compensate for the increase caused by the sputter deposition dopant.

With such method and arrangement, a resistive material such as a chromium diboride compound can be deposited in a relatively thick thin film while still attaining a relatively high sheet resistance such as, for example, 1500 ohms per square or higher. This thickness, which may, for example, be 60 angstroms, enables uniformity and high current densities during operation, and is made possible by sputter depositing the resistive film in a reactive medium such as nitrogen in an argon sputter gas. The percentage of the nitrogen is selected to determine the thickness of the resistive material for a predetermined sheet resistance. Unfortunately, the reactive medium may also increase the temperature coefficient of resistance. Therefore, there may be a trade off in selecting the nitrogen percentage.

The invention may also include the step of depositing a cap layer over the thin film of resistive material. Preferably, the cap comprises free chromium such as in chromium silicon monoxide. With such arrangement, the cap serves to protect the resistive material of the thin film to keep it uniform during subsequent patterning of conductors using a wet etchant such as hydrogen peroxide. The cap layer also serves as a source of free chromium which, during a subsequent heat treatment, diffuses into the grain and grain boundaries of the resistive material of the thin film and reduces the temperature coefficient of resistance. Therefore, because this step tends to drive the temperature coefficient back down, the trade off of selecting the nitrogen percentage for the sputter depositing of the resistive material can be made more advantageously. Further, the thickness ratio between the thin film of resistive material and the cap layer determines or fixes the degree to which the temperature coefficient of resistance is reduced. Therefore, the designer has the option of selecting the final temperature coefficient of resistance by merely adjusting the thicknesses of the respective layers. The thickness ratio may also affect the sheet resistance, so that should be taken into consideration.

BRIEF DESCRIPTION OF THE DRAWINGS

The foregoing objects and advantages will be more fully understood by reading the following description of the preferred embodiment with reference to the drawings wherein.

DESCRIPTION OF THE PREFERRED EMBODIMENT

Figure 1:
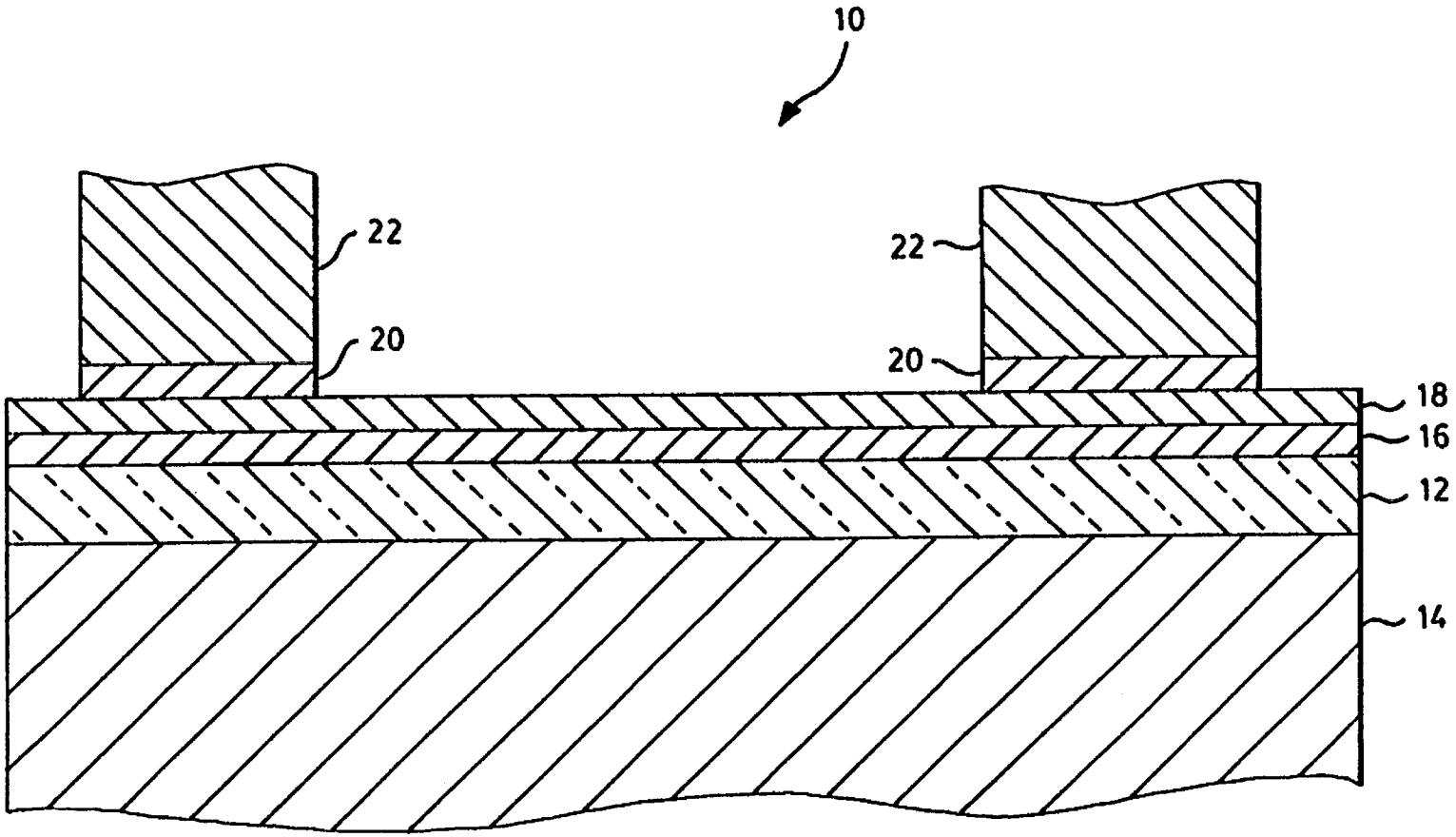
FIG. 1 is a cross sectional view of a semiconductor structure including a thin film resistor.

Referring to FIG. 1, a cross section of a thin film resistor semiconductor structure 10 is shown. A conventional insulative layer 12 such as an oxide or, more particularly silicon dioxide, is disposed over a silicon epitaxial layer 14. A thin film resistor layer 16 of an electrically resistive material such as 85% by atomic weight of chromium diboride ($CrB_2$) and 15% of silicon chromide (SiCr) is sputter deposited over oxide insulative layer 12. As an example, layer 16 may have a thickness of 60 angstroms. The resistive film layer 16 is covered by a protective cap 18 or layer, here chromium silicon monoxide (CrSiO) having a thickness of 8 angstroms. Other features of layer 16 will be discussed with reference to FIGS. 2A–I and the fabrication process.

A titanium tungsten (TiW) overlayer 20 is interposed between aluminum or aluminum-copper (AlCu) interconnection conductors 22 and the CrSiO cap layer 18. The AlCu conductors 22 and TiW layer 20 comprise the primary electrical conductors between circuit elements (not shown), here of the lower or first metal level M1. The TiW layer 20 serves to prevent the aluminum from interdiffusing with and degrading the $CrB_2$ film as well as contiguous, diffused components which form the active circuit elements (not shown).

Figure 2A:
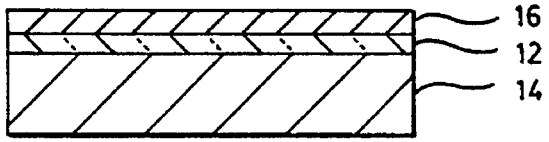
FIGS. 2A–I show sequential stages in the fabrication of a thin film resistor.

Referring to FIGS. 2A–I, cross-sectional views show structure 10 at sequential steps or stages of fabrication. In particular, FIG. 2A shows a silicon epitaxial layer 14 with oxide insulative layer 12 such as silicon dioxide on which a layer 16 of resistive material is sputter deposited. For example, layer 16 may consist of 85% by atomic weight of chromium diboride and 15% silicon chromide with a thickness of 60 angstroms.

Figure 3:
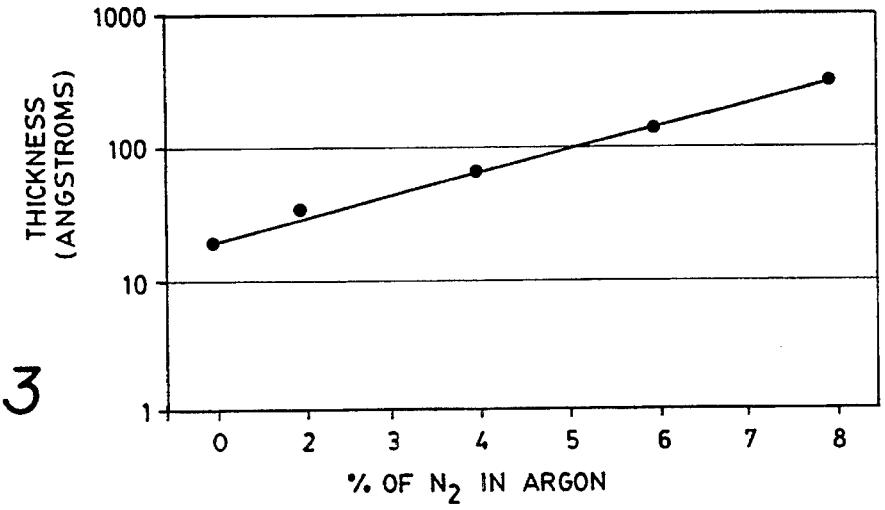
FIG. 3 is a plot showing the relationship between the thickness of an 85% $CrB_2$–15% SiCr resistor film having 1500 ohms per square and the nitrogen percentage in an argon gas used to sputter deposit the resistive film.

In accordance with a feature of the invention, the resistor layer 16 is sputter deposited using a reactive medium that increases, for a predetermined sheet resistance such as 1500 ohms per square, the thickness of resistor layer 16. In particular, for certain resistive materials such as 85% $CrB_2$–15% SiCr, the thickness of a deposited film would have to be undesirably thin in order to have a sheet resistance such as 1500 ohms per square or higher. That is, the layer 16 would be so thin that uniformity could not readily be attained, and the layer would not permit high current densities during operation. Typically, it is desirable to have layers 16 of resistive material that are thicker than 30 angstroms. As shown in FIG. 3, the thickness of an 85% $CrB_2$–15% SiCr resistor film can be increased for a predetermined sheet resistance by increasing the percentage or concentration of nitrogen $N_2$ in the argon sputter gas. Therefore, in order to increase the thickness of resistor layer 16 above what it would normally or inherently be for an intended or target sheet resistance such as 1500 ohms per square, nitrogen, which functions as a dopant, is added to the argon sputter gas to provide a reactive medium forming nitrites in the resistive material of layer 16. The amount or degree of increase in thickness can be controlled or adjusted by selecting a particular nitrogen concentration or percentage as illustrated by FIG. 3.

Figure 4:
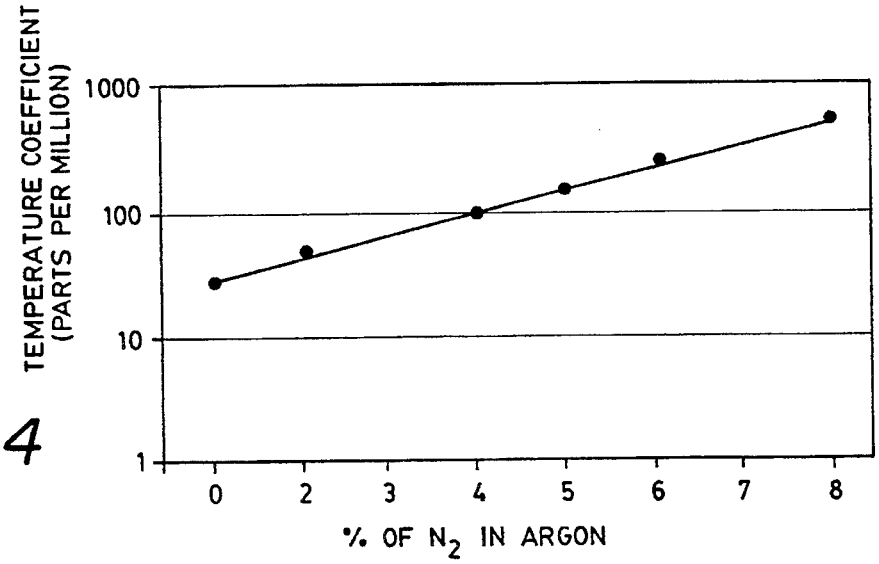
FIG. 4 is a plot showing the relationship between the temperature coefficient of resistance of an 85% $CrB_2$–15% SiCr resistor film having 1500 ohms per square and the nitrogen percentage in an argon gas used to sputter deposit the resistive film.

Referring to FIG. 4, it can also be seen that as the nitrogen percentage or concentration is increased, the temperature coefficient of resistance in parts per million is also increased, whether the increase is from positive to more positive or from negative to more negative. This, however is typically an undesirable effect. That is, the dopant effect of the nitrogen in the sputtering process produces a thin film resistor layer 16 wherein the sheet resistance varies with temperature. In summary, while including a nitrogen concentration in the argon sputter gas provides an advantage in that the thickness of the layer is increased for a target resistance, it also drags along an unwanted effect in that the temperature coefficient of resistance of the resistive material is increased. In accordance with the invention, the nitrogen percentage in the reactive medium can be selected to optimize or trade off the advantages and disadvantages of increasing the concentration or percentage. As will be discussed later with reference to another feature of the invention, another fabrication step and the resulting structure can be used to lower and thereby compensate for increasing the temperature coefficient of resistance by selecting a relatively high concentration of nitrogen ill the argon sputter gas.

Figure 2B:
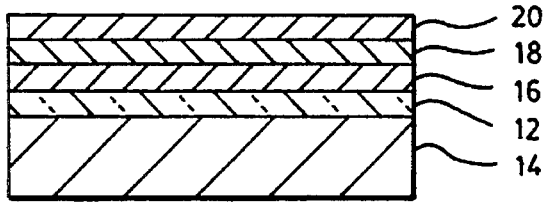

As shown in FIG. 2B, the next steps in the fabrication process are to deposit a chromium silicon monoxide (CrSiO) cap 18 here having a thickness of at least 8 angstroms followed by a titanium tungsten (TiW) layer 20 here having a thickness of 300 angstroms. Clearly, the drawing is not to scale. The etchant protective feature of the CrSiO cap 18 or layer will become apparent later with reference to FIG. 2I. In accordance with another feature of the invention, the CrSiO cap 18 performs another function. In particular, the CrSiO cap 18 is a source of free chromium that functions as a solid diffusant into both the grains and grain boundaries of resistive film layer 16, here $CrB_2$—SiCr, as a result of a subsequent thermal treatment during the integrated circuit multilayer interconnection sequences. In particular, the silicon monoxide is molecularly bonded, but the chromium in the CrSiO is free and therefore diffusible as layer 16 and 18 are heated during subsequent integrated circuit processing. The diffusion of the free chromium into the grains and grain boundaries of the thin film resistive material, here a chromium diboride compound, results in a significant reduction of negative temperature coefficient of resistance accompanied by a small reduction in overall sheet resistivity. Therefore, the inclusion of the CrSiO cap 18 is used to compensate for the temperature coefficient being increased by selecting a relatively high concentration of nitrogen in the argon sputter gas to increase the thickness of the thin film layer 16. Stated differently, the trade off of selecting the concentration of nitrogen in the sputter gas for the $CrB_2$ thin film layer 16 can be influenced and guided by the knowledge that the temperature coefficient of resistance will later be moderated or reduced by diffusion of free chromium from the CrSiO cap 18.

Figure 5:
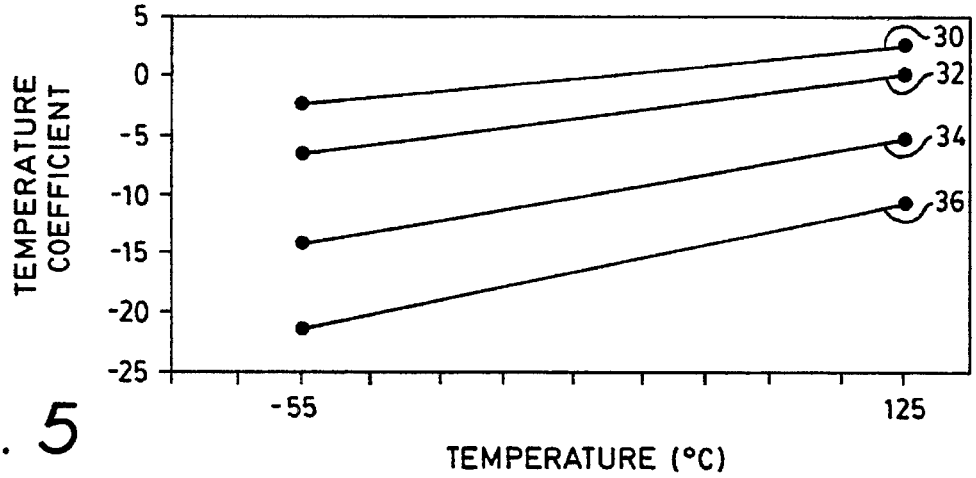
FIG. 5 is a plot of a family of curves showing the relationship between temperature coefficient of resistance and the thickness ratio of the $CrB_2$ resistive layer to the CrSiO cap layer.

Referring to FIG. 5, a family of curves shows the effect that the thickness ratio between the $CrB_2$ resistor layer 16 and the CrSiO cap layer 18 has on the temperature coefficient of resistance. In particular, line 30 shows a curve for a ratio of 1 where layers 16 and 18 have the same thickness. Line 32 shows a curve for a ratio of 2 where layer 16 is twice as thick as layer 18. Line 34 shows a curve for a ratio of 4, and line 36 shows a curve for a ratio of 8. Thus, the thickness of the cap layer 18, and more particularly the thickness ratio of the resistor layer 16 to the cap layer 18 is selected to obtain a desired temperature coefficient of resistance. It may be desirable to have a zero coefficient, or to have a negative or positive coefficient depending on the application. In any event, the thickness ratio between layers 16 and 18 can be selected to provide a predetermined or desired temperature coefficient of resistance as illustrated by FIG. 5.

Figure 6:
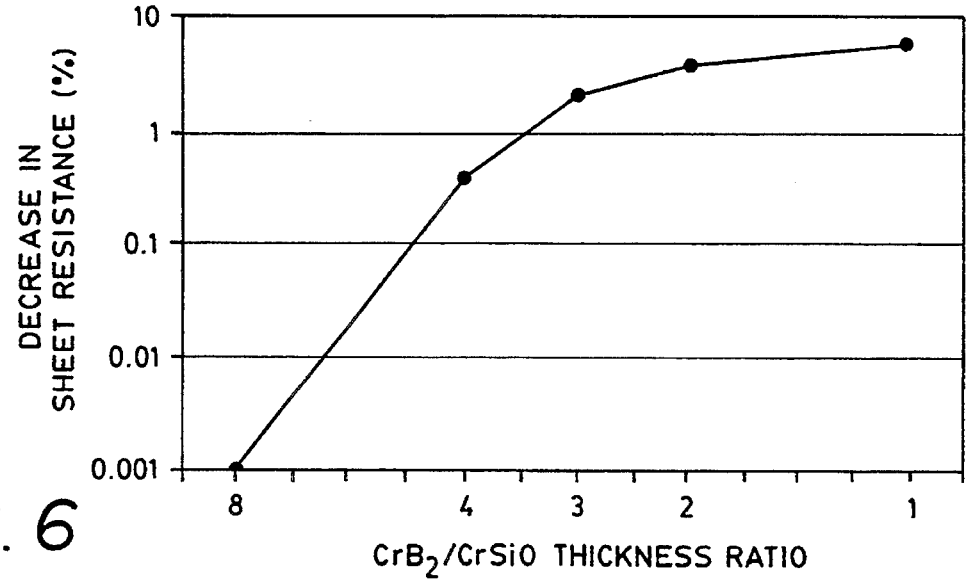
FIG. 6 is a plot showing the relationship between the decrease in sheet resistance and the thickness ratio of the $CrB_2$ resistive layer to the CrSiO cap layer.

Referring to FIG. 6, it can also be seen that the sheet resistance decreases as a function of the thickness ratio between layer 16 and 18. In particular, the decrease in sheet resistance is relatively high for a thickness ratio of 1, and the effect is less for higher ratios. Therefore, the initial sheet resistance is normally made somewhat higher than the target or intended sheet resistance with the knowledge that the sheet resistance will be decreased as a function of the thickness ratio between layer 16 and 18. That is, by knowing what the thickness ratio will be to attain the desired temperature coefficient of resistance, the initial sheet resistance is adjusted so that it will fall to the target or desired sheet resistance. Initial sheet resistance here means the sheet resistance that would have resulted but for the inclusion of layer 18 and the chromium solid diffusant.

Figure 2C:
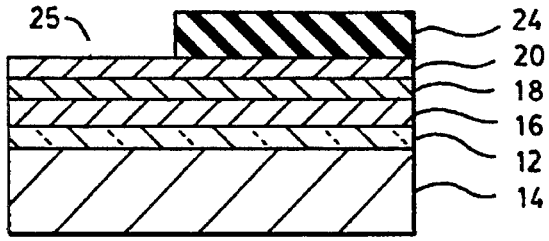
Figure 2D:
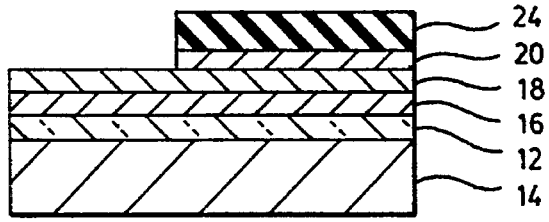

Referring to FIG. 2C, a photoresist emulsion layer 24 is applied in conventional manner to form a thin film mask. Then, an uncovered region 25 of the TiW layer 20 is etched away by wet etch chemistry using hydrogen peroxide $H_2O_2$ or other generic formulation to pattern the TiW layer 20 as shown in FIG. 2D.

Figure 2E:
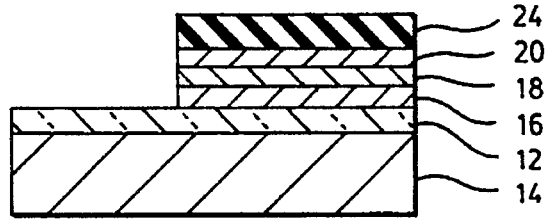
Figure 2F:
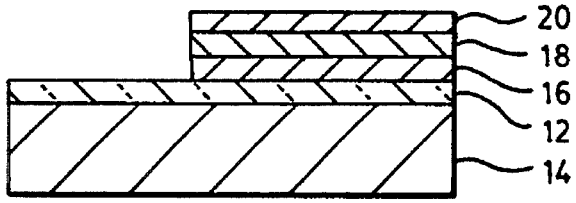

Referring to FIG. 2E, the CrSiO cap 18 and $CrB_2$ thin film layer 16 are patterned by a fluorocarbon plasma etch, and then the photoresist emulsion layer 24 is removed or stripped to form the structure shown in FIG. 2F.

Figure 2G:
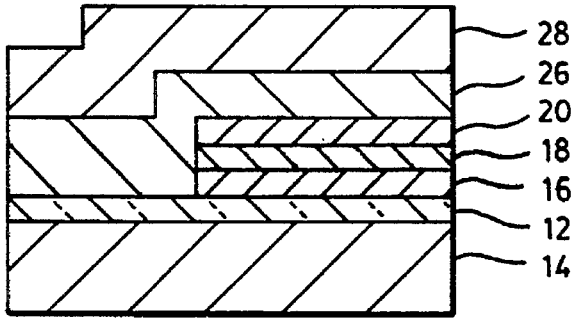

Referring to FIG. 2G, the next steps in the fabrication process are to deposit a titanium tungsten (TiW) barrier layer 26 and an aluminum copper AlCu or aluminum Al interconnect M1 or first level conductor layer 28.

Figure 2H:
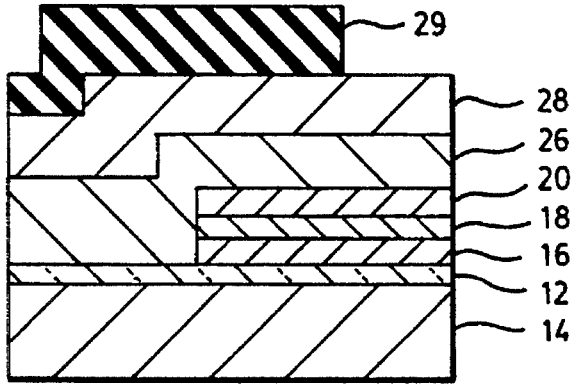
Figure 2I:
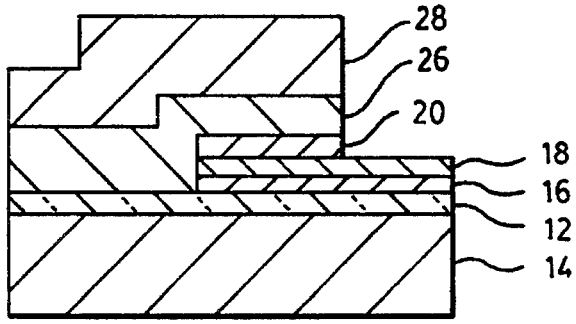

Referring to FIG. 2H, a first level photoresist mask 29 is applied in a desired pattern in conventional manner. Then, the M1 pattern is etched with the CrSiO overlayer or cap 18 protecting the $CrB_2$ of the thin film resistor layer 16 as shown in FIG. 2I. In ! particular, the TiW layer 20 is selectively removed by etching with $H_2O_2$. Cap layer 18 is chemically inert and is interposed between the TiW layer 20 and the $CrB_2$ layer 16. Therefore, the $H_2O_2$, or any other TiW dissolving formulation that is used, does not come in contact with the $CrB_2$ thin film resistor layer 16. Without the presence of the CrSiO cap layer 18, the $H_2O_2$ could attack the $CrB_2$. Any $CrB_2$ removed would cause both local and global degradation of both sheet resistance and film uniformity. The cap layer 18 preferably has a high sheet resistance relative to the $CrB_2$, but not so high that it presents an electrical impedance which degrades critical circuit parameters. Conversely, the cap layer 18 should not have so low a sheet resistance as to be unfavorable to the inherent properties of $CrB_2$. In a preferred embodiment, cap layer 18 is 55% Cr and 45% SiO by weight, and is sputter deposited to a minimum of 8 angstroms thickness and in-situ overlayed with a TiW barrier film of 300 angstroms.

An 8 angstrom CrSiO layer 18 provides adequate coverage and chemical resistance to protect the underlying $CrB_2$ thin film resistor layer 16 from chemical attack by $H_2O_2$ during the TiW patterning operation as described with reference to FIG. 2I. At all 8 angstrom thickness of cap 18, the intrinsic electrical properties of the $CrB_2$ remain substantially unchanged. However, as described earlier with reference to FIG. 5 and 6, increasing the thickness of the CrSiO cap 18 thickness and thereby lowering the thickness ratio for layer 16 and 18 incrementally lowers the sheet resistance and has the effect of adjusting the reduction of the temperature coefficient of resistance. In particular, FIG. 5 shows a family of curves for different $CrB_2$/CrSiO thickness ratios, and it can be seen that selection of a particular ratio allows a degree of freedom in the determination of resistor properties. Both positive and negative temperature coefficient characteristics can be attained by selecting a thickness ratio within a specific composite thickness range.

Although the invention can be used to advantage with many different materials and parameters, one illustrative process will be described. A resistive layer 16 of 85% chromium diboride and 15% silicon chromide is sputter deposited on an insulative substrate 12 with an argon reactive sputter medium having a 2% nitrogen concentration. The resistive layer 16 is deposited to a thickness of 60 angstroms. In this state before subsequent thermal treatment, the layer 16 is without crystalline form. That is, the structure is amorphous. In such state, it is not possible to quantify the temperature coefficient of resistance because this term only becomes meaningful after a crystalline structure is formed. If layer 16 were analyzed at this stage, the sheet resistance would be approximately 1900 ohms per square. Next, a chromium silicon monoxide cap 18 is deposited with a thickness of approximately 10 angstroms. Therefore, the thickness ratio between layers 16 and 18 is approximately 6:1. During a subsequent conventional annealing process, the temperature is raised to approximately 490 degrees centigrade for approximately 30 minutes. This thermal or heat treatment diffuses the solid diffusant, here the free chromium from layer 18, into layer 16 in a timed release manner. Under these controlled conditions, the free chromium locates in the grains and grain boundaries as a crystalline structure is formed. As a result, the sheet resistance is decreased from what it would otherwise be without the solid diffusant free chromium. Here, it decreases down to the target or intended value of 1500 ohms per square. Also, the temperature coefficient of resistance is driven back down from what it would be after being increased by using a nitrogen percentage in the sputter gas. In this final configuration, there are stabilized grain structures and boundaries.

This concludes the description of the preferred embodiment. A reading of it by one skilled in the art will bring to mind many alterations and modifications that do not depart from the spirit and scope of the invention. Therefore, it is intended that the scope of the invention be limited only by the appended claims.

What is claimed is:

1. A method of fabricating a thin film resistor, comprising the steps of:

sputter depositing a thin film of a resistive material having a thickness and a temperature coefficient of resistance on an insulative substrate in a reactive medium to increase, for a given sheet resistance, the thickness of the thin film while also increasing the temperature coefficient of resistance of the resistive material; and depositing on the thin film a cap layer comprising chromium silicon monoxide and heat treating the thin film and the cap layer wherein free chromium from the cap layer diffuses into the resistive material of the thin film to reduce the increased temperature coefficient of resistance of the resistive material resulting from the sputter depositing in the reactive medium.

2. The method recited in claim 1 wherein the reactive medium comprises a dopant.

3. The method recited in claim 1 wherein the reactive medium comprises nitrogen.

4. The method recited in claim 1 wherein the resistive material comprises chromium diboride.

5. The method recited in claim 4 wherein the resistive material consists of 85% chromium diboride and 15% silicon chromide by atomic weight.

6. The method recited in claim 1 further comprising a step of selecting a thickness ratio between the thin film and the cap layer to determine the temperature coefficient of resistance of the resistive material.

* * * * *